United States Patent [19]

Hogan

[11] 4,019,779

[45] Apr. 26, 1977

[54] LAMINATED ARMREST

[75] Inventor: Gerard T. Hogan, Southington, Conn.

[73] Assignee: Universal Oil Products Company, Des Plaines, Ill.

[22] Filed: Sept. 8, 1975

[21] Appl. No.: 611,475

Related U.S. Application Data

[62] Division of Ser. No. 537,482, Dec. 30, 1974, abandoned.

[52] U.S. Cl. ..... 297/411; 297/414

[51] Int. Cl.[2] ..... A47C 7/54

[58] Field of Search ..... 297/412, 414, 416, 115, 297/422, 227, 232; 5/361 B, DIG. 2

[56] References Cited

UNITED STATES PATENTS

| | | | |
|---|---|---|---|
| 2,524,659 | 10/1950 | Gorman | 297/414 |
| 2,804,125 | 8/1957 | Adams | 297/414 |
| 3,124,390 | 3/1964 | Eames et al. | 297/232 X |
| 3,362,749 | 1/1968 | Clement | 297/412 |
| 3,400,979 | 9/1968 | James | 297/412 |
| 3,893,729 | 7/1975 | Sherman et al. | 297/232 X |

FOREIGN PATENTS OR APPLICATIONS

| | | | |
|---|---|---|---|
| 906,265 | 9/1962 | United Kingdom | 5/361 B |

*Primary Examiner*—Ramon S. Britts
*Assistant Examiner*—Darrell Marquette
*Attorney, Agent, or Firm*—James R. Hoatson, Jr.; Barry L. Clark; William H. Page, II

[57] ABSTRACT

Laminated cushion formed of a plurality of alternating, relatively rigid and relatively soft layers of resilient foam has a higher compression rate in the direction of an axis parallel to the planes of the layers than in the transverse direction. Thus, when the cushion is positioned with the planes of the layers arranged vertically, the cushion is usable as an armrest. When it is positioned with the planes of the layers arranged horizontally, it is usable as a pillow. In a modification, the cushion can be added to the side of a conventional armrest on an aircraft passenger seat to increase the width thereof while being easily compressed sideways to accommodate larger framed passengers.

1 Claim, 4 Drawing Figures

Fig. 1
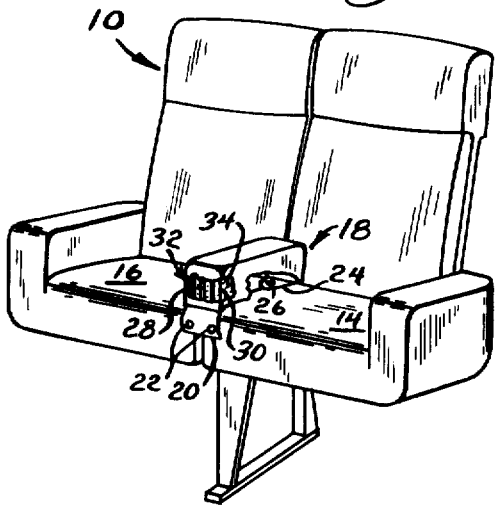
Fig. 2
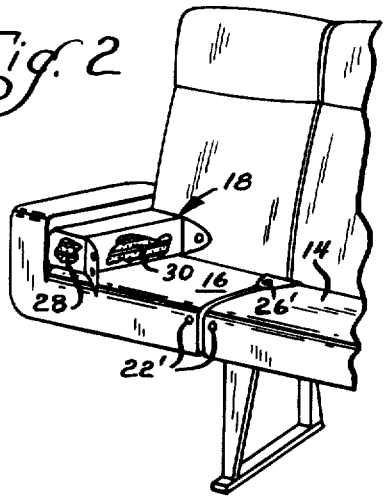
Fig. 4
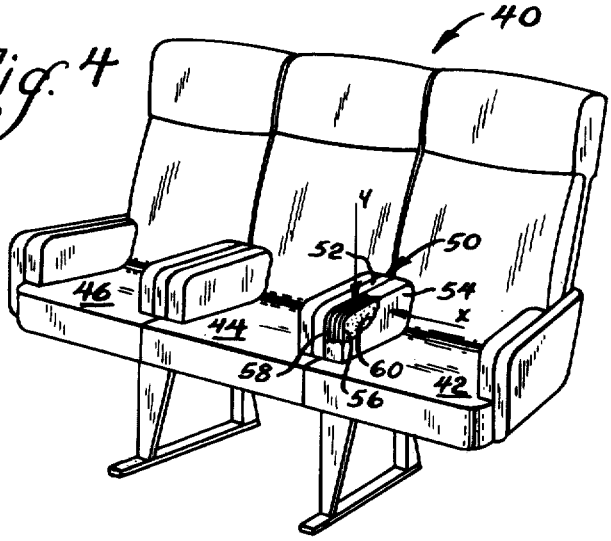
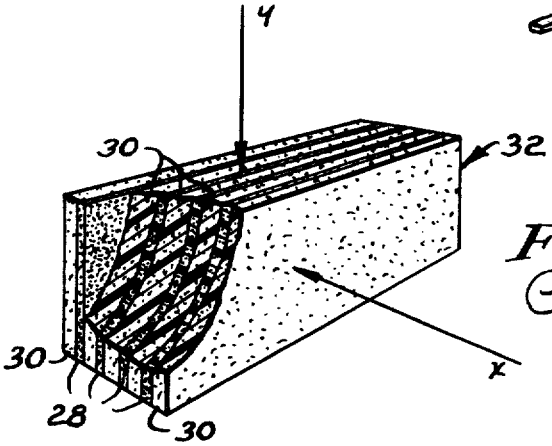
Fig. 3

LAMINATED ARMREST

This is a division of application Ser. No. 537,482, filed Dec. 30, 1974 abandoned.

BACKGROUND OF THE INVENTION

The invention relates to multi-occupant seating such as aircraft passenger seating wherein the occupants are separated by armrests. With the advent of newer wide body aircraft there has been some increase in the width of seats, especially in the first class cabin, from that used in older aircraft. Some of the extra width has gone into wider armrests separating the seats. The wide armrests have proven popular and present a somewhat luxurious appearance to coach class passengers who normally have quite narrow armrests separating them from adjacent passengers. Since seats are usually built to accommodate the larger framed passenger it is obvious that they are wider than necessary for the average passenger. It would seem desirable, therefore, to provide a seat and armrest combination wherein the armrest is ordinarily quite wide but which can be reduced in size to accommodate a large passenger. Such seating would have the esthetically pleasing features of wide armrests as well as the functional advantage that normal sized adjacent passengers could each use the armrest rather than have to compete for its use as is normal with narrow armrests.

Another feature of some aircraft seating which some passengers find annoying is what to do with the armrest between a pair of seats when one of the seats is empty and the occupant of the other seat wants to lie down and rest. Many armrests pivot into the seat back, but usually not quite far enough to avoid being uncomfortable to a person lying down. Although pillows are often available, there are usually not enough for everyone and they are usually too small to be a true substitute for a bed pillow. It would thus also be an advantage if the armrest could also serve as a pillow.

SUMMARY

It is among the objects of this invention to provide an improved laminated armrest cushion which can be used either by itself as an alternative armrest and pillow or attached to a conventional armrest to increase the width thereof while being easily compressed sideways to accommodate larger framed passengers. The improved cushion comprises a plurality of alternating layers of relatively rigid and relatively soft resilient form which are bonded together by a suitable adhesive. When the layers are arranged so that their planes are vertical, the cushion is quite resistant to downward pressure and therefore functions well as an armrest. When the cushion is compressed sideways in a direction normal to the planes of its layers it offers much less resistance and therefore functions well as a pillow or as an armrest whose width is automatically reduced by the side pressure exerted on it by a large framed passenger. In a test cushion made of six 1 in. thick layers of soft polyurethane foam bonded to five ½ in. thick layers of relatively rigid, closed cell polyvinyl chloride foam, a deflection measurement over a 50 in.$^2$ area in response to a 35 pound load showed a deflection, as compared to a one pound load, of about 4 in. in a direction normal to the planes of the layers and a deflection of only about 0.9 in. in a downward direction parallel to the plane of the layers. The soft foam was grade UU-15 on a super soft to very firm scale of 9–44 promulgated by the Society of Plastics Industries, Inc. The relatively rigid foam had a density of about 3–5 pounds per cubic foot. The adhesive was type EC 2155 sold by 3M Company, and having a synthetic rubber base.

BRIEF DESCRIPTION OF THE DRAWING

FIG. 1 is a perspective view showing the improved armrest cushion attached to a seating unit for use as an armrest;

FIG. 2 is a fragmentary perspective similar to FIG. 1 but showing the armrest cushion rotated 90° from its FIG. 1 armrest position for use as a pillow;

FIG. 3 is a perspective view showing the laminated foam assembly which is positioned inside the armrest cushion of FIGS. 1 and 2; and FIG. 4 is a perspective view of a modification wherein laminated foam material of the type shown in FIG. 3 is attached to a conventional armrest to increase the width thereof.

DESCRIPTION OF THE PREFERRED EMBODIMENTS

Referring to FIG. 1, a two passenger seating unit indicated generally at 10 includes a pair of side-by-side seats 14, 16 separated by an armrest cushion indicated generally at 18. The cushion 18 includes an anchor tab portion 20 made of upholstery fabric which includes a pair of snap fasteners 22 which engage complementary snap fasteners 22' on the seats 14, 16 (FIG. 2) to retain the cushion in proper position. A rear anchor tab 24 on the cushion 18 includes a snap fastener 26 which engages a complementary snap fastener 26' mounted on the seating unit 10. Obviously, other fastening means could also be used. The cushion 18 comprises a plurality of relatively rigid foam layers 28 and a plurality of relatively soft foam layers 30 which are bonded together in a laminated foam assembly indicated generally at 32 which is covered by upholstery material 34. As previously discussed, the arrangement of the planes of the foam layers in a vertical direction as shown in FIG. 1 produces a structure which is quite resistant to downward loading in the direction "Y" shown in FIG. 3 while having very little resistance to loading in a sideways direction in the direction of the axis "X" in FIG. 3. As a result, the cushion 18 performs well as an armrest as shown in FIG. 1 while also functioning well as a pillow when the planes of the foam layers are rotated 90° to the position shown in FIG. 2.

In FIG. 3 the layers of soft foam material 30 are shown as being of approximately twice the width of the more rigid or dense foam layers 28. The particular foam thicknesses used are not of extreme importance as long as the cushion performs as desired. For example, if the soft foam layer 30 closest to a passenger in a seat 14 is too thick, the armrest will offer little resistance to downward pressures applied as the passenger trys to lift himself up from the seat by applying pressure to the armrest. Conversely, if the outside layer of foam 30 is too thin, the cushion will not be as comfortable as one might desire when it is used as a pillow (FIG. 2).

Referring to FIG. 4, a modification of the invention is shown wherein a three passenger tourist class seating unit indicated generally at 40 includes seats 42, 44, and 46 which are separated by armrest members indicated generally at 50. The armrests 50 include a rigid center member 52 which may be of conventional construction. Attached on either side of the rigid center members 52 are laminated armrest portions 54 which are made up of a plurality of soft foam layers 56 laminated to relatively hard foam layers 58 and covered by upholstery material 60. Since the laminated armrest portion 54 is attached to the rigid armrest portion 54 is attached to the rigid armrest member 52 it cannot be used as a pillow but it does serve the function of increasing the width of the armrest 50 so as to provide more elbow space for each of the passengers using the armrest. The wide armrest also presents a more luxurious appearance to the seat. Although the thickness of the laminated armrest portions 54 appear to decrease the hip room available in seats 42, 44, 46, the seats are preferably made to provide sufficient hip room for an average sized passenger without requiring compression of the laminated armrest portion 54. When a larger framed passenger occupies the seat, the soft foam layers 56 are readily compressed without causing discomfort to the passenger.

I claim as my invention:

1. In combination, a multi-passenger seat and an armrest for separating a pair of adjacent seating positions thereon, the armrest having a pair of armrest portions on either side of a rigid central support member, said armrest portions offering greater resistance to loading in a vertical direction than in a sideways direction so that their deflection for a given loading is at least three times greater sideways than downwardly, said armrest portions each comprising a plurality of spaced layers of relatively rigid foam and a plurality of spaced layers of relatively soft foam, said soft foam layers having a thickness not exceeding about one inch and said rigid foam layers being of lesser thickness, said rigid foam layers and said soft foam layers being alternately bonded to each other in vertical planes and attached to each side of said rigid central support member.

* * * * *